US005340711A

United States Patent [19]

Kim

[11] Patent Number: 5,340,711

[45] Date of Patent: Aug. 23, 1994

[54] GREEN SENSITIZED SILVER HALIDE EMULSIONS

[75] Inventor: Sang H. Kim, Pittsford, N.Y.

[73] Assignee: Eastman Kodak Company, Rochester, N.Y.

[21] Appl. No.: 5,316

[22] Filed: Jan. 15, 1993

[51] Int. Cl.[5] ..... G03C 1/18; G03C 1/29

[52] U.S. Cl. ..... 430/576; 430/588

[58] Field of Search ..... 430/576, 588

[56] References Cited

U.S. PATENT DOCUMENTS

| | | | |
|---|---|---|---|
| 3,580,724 | 5/1971 | Sato et al. | 96/124 |
| 4,571,380 | 2/1986 | Noguchi et al. | 430/589 |
| 4,594,317 | 6/1986 | Sasaki et al. | 430/574 |
| 4,889,796 | 12/1989 | Ikegawa et al. | 430/549 |
| 4,970,141 | 11/1990 | Ikegawa et al. | 430/550 |
| 4,971,889 | 11/1990 | Ikeda et al. | 430/576 |

FOREIGN PATENT DOCUMENTS

| | | | |
|---|---|---|---|
| 472004 | 7/1991 | European Pat. Off. . | |
| 60-042750 | 8/1983 | Japan . | |
| 62-220948 | 9/1987 | Japan . | |
| 62-222245 | 9/1987 | Japan . | |
| 1-235944 | 3/1988 | Japan . | |
| 1-210952 | 8/1989 | Japan | 430/588 |
| 4-251243 | 1/1991 | Japan . | |
| 4-050941 | 2/1992 | Japan | 430/576 |

*Primary Examiner*—Janet C. Baxter
*Attorney, Agent, or Firm*—Gordon M. Stewart

[57] ABSTRACT

A silver halide photographic element having a green sensitive layer the silver halide of which is sensitized by a combination of three sensitizing dyes of the formula I, II and III:

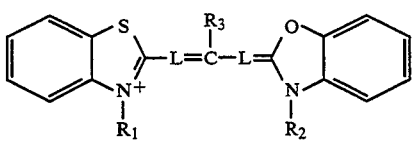

(I)

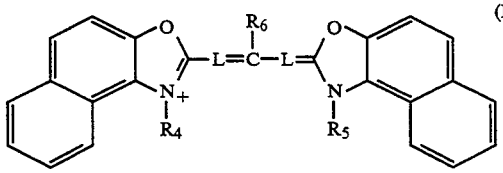

(II)

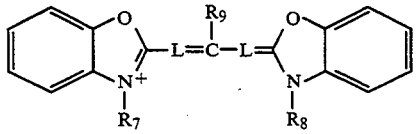

(III)

wherein:

each of the benzo-rings of I, II or III may be substituted or unsubstituted;

each L is a substituted or unsubstituted methine; and

R1 through R9 are substituted or unsubstituted alkyl or aryl.

16 Claims, No Drawings

GREEN SENSITIZED SILVER HALIDE EMULSIONS

FIELD OF THE INVENTION

This invention relates to silver halide photographic emulsions sensitized in the green spectral region.

BACKGROUND OF THE INVENTION

Silver halide photography usually involves the exposure of silver halide photographic element with light in order to form a latent image that is developed during photographic processing to form a visible image. Silver halide is intrinsically sensitive only to light in the blue region of the spectrum. In order to sensitize the silver halide to other than the blue region, sensitizing dyes are used in the silver halide emulsion. Sensitizing dyes are chromophoric compounds (usually cyanine dye compounds). Their usual function is to adsorb to the silver halide and to absorb light (usually other than blue light) and transfer that energy via an electron to the silver halide grain thus, rendering the silver halide sensitive to radiation of a wavelength other than the blue intrinsic sensitivity. However, sensitizing dyes can also be used to augment the sensitivity of silver halide in the blue region of the spectrum.

Sensitizing dyes are typically selected which provide a high sensitivity to the emulsion in the wavelength region of interest. An increased sensitivity of an emulsion without increasing grain size also allows for an improvement in sharpness and/or a lowering of graininess. Higher sensitivities can also allow higher color saturation. Usually the sensitizing dyes are also selected such that the emulsion has accurate spectral response to enable the building of films having correct color reproduction. For example, a photographic element containing a green sensitized emulsion which has a peak sensitivity around 555 nm, will tend to reproduce red and orange objects with a magenta contamination due to lack of long green sensitivity.

In building photographic elements, it is also known to use strongly adsorbing additives, as stabilizers or antifoggants. These include azoles, mercaptocompounds, thioketocompounds, and azaindenes. In particular a 4-hydroxy substituted (1,3,3a,7)-tetraazaindene, such as 4-hydroxy-6-methyl-1,3,3a,7-tetraazaindene ("TAI"), is often used as a stabilizer. Such additives, particularly TAI, often desensitize emulsions apparently by desorbing sensitizing dyes from the emulsion grain surfaces. Thus, an emulsion which might otherwise have high sensitivity throughout the wavelength region of interest to provide correct color reproduction, may lose speed when a large amount of a strongly adsorbing additive (particularly TAI) is added.

Silver halide sensitizing dyes are of the cyanine type are well known. For example, U.S. Pat. No. 4,362,813 discloses combinations of bis-benzoxazoles and oxathiazole type dyes. However, the dyes described exclude bis-napthoxazole types. U.S. Pat. No. 4,594,317 generally describes combinations of three dyes. The patent specifically indicates that bis-napthoxazole type dyes are non-preferred. Other multiple dye combinations are disclosed, for example, in U.S. Pat. Nos. 5,041,366 and 4,571,380.

It would be desirable then, to provide a photographic element which is sensitized in the green region by dyes which provide a high maximum sensitivity, as well as preferably having good long green sensitivity, and which are affected to a lower extent by additives such as TAI.

SUMMARY OF THE INVENTION

The present invention provides a silver halide photographic element having a green sensitive layer comprising a combination of three sensitizing dyes of formulae I, II and III:

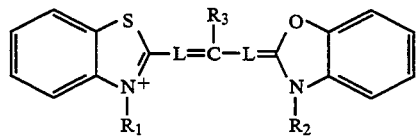

(I)

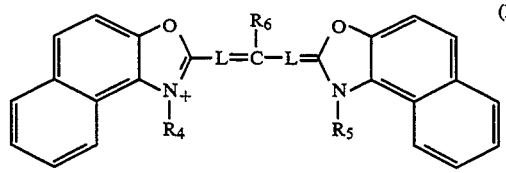

(II)

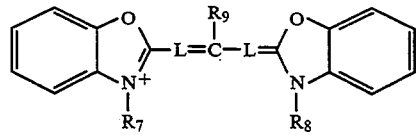

(III)

wherein:

each of the benzo-rings of I, II or III may be substituted or unsubstituted;

each L is a substituted or unsubstituted methine; and

R1 through R9 are substituted or unsubstituted alkyl or aryl.

Photographic elements with the above emulsions tend to have a high sensitivity, as well as a maximum absorption in longer green wavelengths, and lowered sensitivity to the desensitizing effects of strongly adsorbing additives- The increased sensitivity makes the emulsions particularly useful with development inhibitor releasing compounds.

DETAILED DESCRIPTION OF EMBODIMENTS OF THE INVENTION

In the above formulae I, II and III, various substituents for the back rings (by "back rings" is meant the benzyl ring fused with oxazole or thiazole ring) can include known substituents, such as halogen (for example, chloro, fluoro, bromo, iodo), hydroxy, alkoxy (for example, methoxy, ethoxy), substituted or unsubstituted alkyl (for example, methyl, trifluoromethyl), alkenyl, thioalkyl (for example, methylthio or ethylthio), substituted and unsubstituted aryl (for example, phenyl, 5-chlorophenyl, although aryl groups are less preferred) and others known in the art. The methine groups, L, are preferably not substituted but, when substituted, the substituents may include alkyl (preferably a "lower alkyl", that is having from 1 to 6 carbon atoms, for example, methyl, ethyl, and the like), or aryl (for example, phenyl, thienyl, furyl, pyrrolyl). Additionally, substituents on the methine groups may form bridged linkages. It will be understood that a counterion, not shown in the formulae of I, II and III, may be present as necessary to balance the charge of the dye molecule. Such counterions may include known counterions such as sodium, potassium, triethylammonium, and the like.

R1, R2, R4, R5, R7 and R8 may independently represent substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, and the like. Examples of alkyl include methyl, ethyl, propyl, and the like, as well as substituted alkyl groups (preferably a substituted lower alkyl) such as a hydroxyalkyl group (for example, 2-hydroxyethyl; or a sulfoalkyl group such as 2-sulfobutyl, 3-sulfopropyl and the like). The alkyl or aryl group may be substituted by one or more of the substituents on the above-described substituted alkyl groups. R3, R6 and R9 may include H, or substituted or unsubstituted alkyl or alkoxy and the like, but is preferably a lower alkyl (most preferably, unsubstituted alkyl).

It is preferred that each of the three dyes has at least one acid or acid salt group, typically present on R1 or R2, R4 or R5, and R7 or R8. Optionally, all of R1, R2, R4, R5, R7 and R8 may have an acid or acid salt group (for example, a sulfo group or a group of the type —$CH_2$—CO—NH—$SO_2$—$CH_2$—). It is generally preferred that the dyes have substitutents such that each of them is anionic or zwitterionic (that is, no net charge). However, it will be understood that any of the dyes may be cationic.

While the amounts of the dyes of formulae I, II and III can be varied within a wide range, typically the total amount of sensitizing dye that is useful in an emulsion of elements of the invention is preferably in the range of 0.01 to 5.0 millimoles per mole of silver halide. More preferably, the foregoing range is between 0.02 to 2.5 millimoles per mole of silver halide. Optimum dye concentrations can be determined by methods known in the art. As to the relative amounts of I, II and III, a preferable range of I:II:III is from 1:1.2:2.3 to 1:4:8, with the ratio of 1:1.3:2.5 to 1:3.5:6.5 being particularly preferred.

Photgraphic elements of the present invention may also include a development inhibitor releasing compound (DIR), that is a compound which releases a development inhibitor during processing with color developer. Such compounds include DIARs which provide timed release of the development inhibitor. The high sensitivity provided by the combination of Dyes I, II and III assists in providing high color saturation in reversal films which have DIR compounds present. The development inhibitor is in a layer associated with the layer in which the green dyes are present. By "associated" is meant that the development inhibitor is in a layer such that it can have an effect on the green sensitive layer. Particular development inhibitors for use in reversal films are described in U.S. patent application Ser. No. 08/004,027 entitled "Image Formation In Color Reversal Materials Using Strong Inhibitors", filed on the same date as this application. By using such development inhibitors with or without the present dyes, photographic elements can be constructed such as described in U.S. patent application Ser. No. 08/005,474 for "Color Photographic Reversal Element With Improved Color Reproduction", filed on the same date as this application.

In a preferred embodiment of the invention, the three dyes are of the formulae:

(Ia)

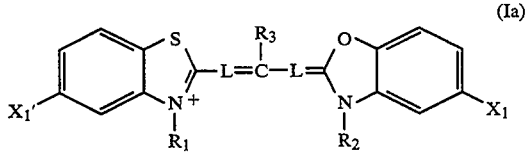

(IIa)

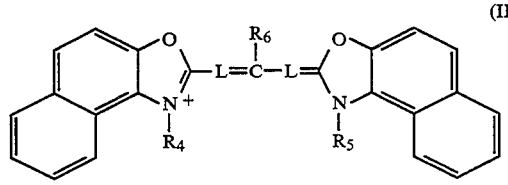

(IIIa)

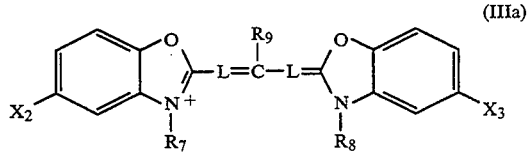

wherein:

each of the back rings may be substituted with substituents described above or are preferably unsubstituted other than for X1, X2 and X3;

R1–R9 are as defined above;

one of X1 or X1′ is a halogen or a substituted or unsubstituted aryl, while the other one is H;

X2 and X3 are both halogen.

Preferably, in Ia, IIa, and IIIa, are independently Cl or F, preferably Cl.

Particular dyes of the present invention include the following dyes:

I-1

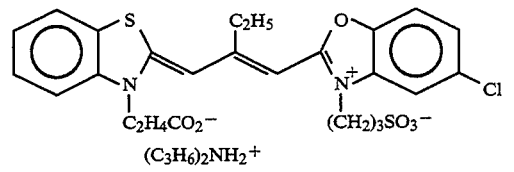

I-2

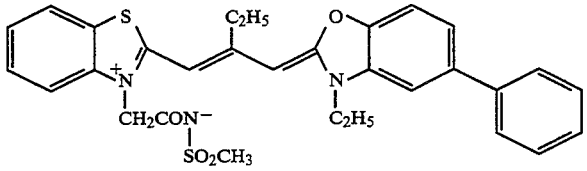

II-1

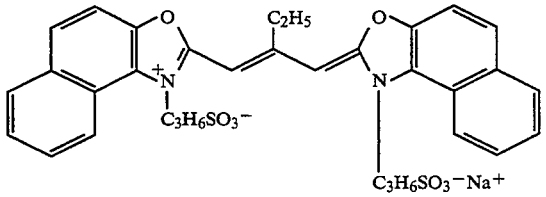

-continued

III-1

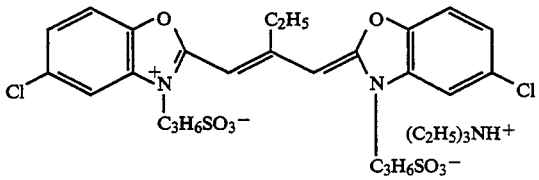

| Type I-Dyes | | | | |
|---|---|---|---|---|
| # | $X_1$ | $R_2$ | $R_1$ | $X_1'$ |
| I-3 | Cl | —SP⁻ | $-C_2H_5$ | H |
| I-4 | Cl | —SP⁻ | —SP⁻ | $-OCH_3$ |
| I-5 | Ph | —SP⁻ | $-C_2H_5$ | H |
| I-6 | Ph | —SP⁻ | $-(CH_2)_4SO_3^-$ | $-CH_3$ |
| I-7 | Ph | $-(CH_2)_2SO_3^-$ | $-(CH_2)_2-Ph-SO_3^-$ | —Cl |
| I-8 | Cl | —SP⁻ | $-(CH_2)_4SO_3^-$ | $-CH_3$ |
| I-9 | Cl | —SP⁻ | $-C_2H_5$ | Cl |
| I-10 | Ph | —SP⁻ | $-(CH_2)_4SO_3^-$ | H |
| I-11 | Ph | $-(CH_2)_3CO_2^-$ | $-(CH_2)_3CO_2-$ | H |
| I-12 | Ph | $-(CH_2)_3CO_2^-$ | $-(CH_2)_3CO_2-$ | $-OCH_3$ |
| I-13 | ph | $-(CH_2)_2CO_2^-$ | $-(CH_2)_4SO_3-$ | Ph |
| I-14 | Ph | —SP⁻ | $-C_2H_5$ | H |

$R_3 = -C_2H_5$ for all of I-3 to I-14
—SP⁻ = 3-sulfopropyl

| Type II Dyes | | | |
|---|---|---|---|
| Dye No. | $R_4$ | $R_6$ | $R_5$ |
| II-2 | $-C_3H_6SO_3K$ | $-C_2H_5$ | $-C_3H_6SO_3^-$ |
| II-3 | $-CH_3$ | $-C_2H_5$ | $-C_3H_6SO_3^-$ |
| II-4 | $-C_2H_5$ | $-CH_3$ | $-C_3H_6SO_3^-$ |
| II-6 | $-(CH_2)_2-SO_3H.N(C_2H_5)_3$ | $-C_2H_5$ | $-C_2H_4SO_3^-$ |

-continued

| Type II Dyes | | | |
|---|---|---|---|
| Dye No. | $R_4$ | $R_6$ | $R_5$ |
| II-7 | $-(CH_2)_3-SO_3H.N(C_2H_5)_3$ | $-C_2H_5$ | $-C_3H_6SO_3^-$ |
| II-8 | $-(CH_2)_2-SO_3H.N(C_2H_5)_3$ | $-C_2H_5$ | $-C_2H_4SO_3^-$ |
| II-9 | 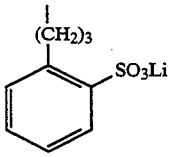 | $-C_2H_5$ | 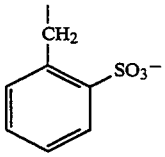 |
| II-10 | 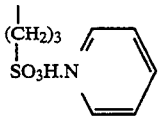 | $-C_2H_5$ | $-C_3H_6SO_3^-$ |
| II-11 | $-(CH_2)_2-CHCH_3-SO_3Na$ | $-C_2H_5$ | $-(CH_2)_2-CHCH_3-SO_3^-$ |
| II-12 | $-CH_2CO_2H$ | $-C_2H_5$ | $-C_3H_6SO_3^-$ |

Type III Dyes

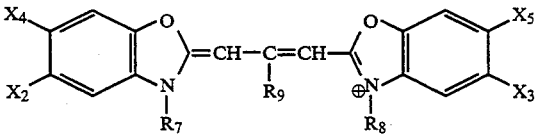

| Dye No. | $X_2$ | $X_4$ | $R_7$ | $R_9$ | $R_8$ | $X_3$ | $X_5$ |
|---|---|---|---|---|---|---|---|
| III-2 | —Cl | H | $-C_3H_6SO_3^-$ | $-C_2H_5$ | $-C_4H_8SO_3^-$ | —Cl | H |
| III-4 | 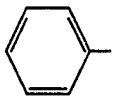 | H | $-(CH_2)_3-SO_3H.N(C_2H_5)_3$ | $-C_2H_5$ | $-(CH_2)_3-SO_3K$ | 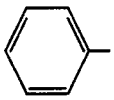 | H |
| III-5 | —Cl | H | $-C_2H_4SO_3Na$ | $-C_2H_5$ | $-C_2H_4SO_3^-$ | —Cl | H |
| III-6 | $-CH_3$ | H | $-C_2H_5$ | $-C_2H_5$ | $-C_4H_8SO_3^-$ | $-CH_3$ | H |
| III-7 | —Cl | $-CH_3$ | 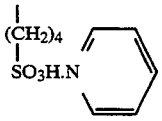 | $-C_2H_5$ | $-C_4H_8SO_3^-$ | —Cl | $-CH_3$ |
| III-8 | $-OCH_3$ | H | $-C_3H_6SO_3Na$ | $-C_2H_5$ | $-C_2H_4SO_3^-$ | $-OCH_3$ | H |
| III-9 | $-OC_2H_5$ | H | $-C_4H_8SO_3Na$ | $-C_2H_5$ | $-C_4H_8SO_3^-$ | $-OC_2H_5$ | H |
| III-10 | —OH | H | $-C_2H_5$ | $-C_2H_5$ | $-C_4H_8SO_3^-$ | —OH | H |

-continued

Type III Dyes

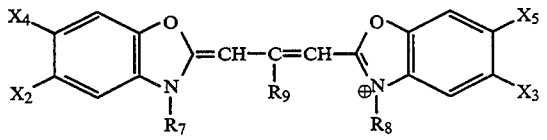

| Dye No. | $X_2$ | $X_4$ | $R_7$ | $R_9$ | $R_8$ | $X_3$ | $X_5$ |
|---|---|---|---|---|---|---|---|
| III-11 | H | $-CH_3$ | $-(CH_2)_3-SO_3H.N(C_2H_5)_3$ | $-C_2H_5$ | $-C_3H_6SO_3^-$ | $-CH_3$ | H |

The use of such dyes can provide high sensitivity. In addition, relatively low sensitivity to the effect of TAI can be obtained as well as a green sensitivity within the desired range of 550 to 580 μm. Preferably, the sensitivity is substantially constant over the foregoing range or at least a portion of that range (for example, 555–575 μm; 560–575 μm; or 560–580 μm).

Dyes of formula I, II or III can be prepared from the above dye precursors according to techniques that are well-known in the art, such as described in Hamer, *Cyanine Dyes and Related Compounds,* 1964 (publisher John Wiley & Sons, New York, N.Y.) and James, *The Theory of the Photographic Process* 4th edition, 1977 (Eastman Kodak Company, Rochester, N.Y.).

The silver halide used in the photographic elements of the present invention may be silver bromoiodide, silver bromide, silver chloride, silver chlorobromide, silver chlorobromo-iodide, and the like. The type of silver halide grains preferably include polymorphic, cubic, and octahedral. However, tabular grain emulsions can also be used. Tabular silver halide grains are grains having two substantially parallel crystal faces that are larger than any other surface on the grain. Tabular grain emulsions are those in which greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in μm and t is the average thickness in μm of the tabular grains.

The grain size of the silver halide may have any distribution known to be useful in photographic compositions, and may be ether polydipersed or monodispersed.

The silver halide grains to be used in the invention may be prepared according to methods known in the art, such as those described in *Research Disclosure,* (Kenneth Mason Publications Ltd, Emsworth, England) Item 308119, December, 1989 (hereinafter referred to as *Research Disclosure I*) and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by dyes of the present invention by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours). The dyes may be added in any order to the emulsion, but the preferred order of addition is type I, then II, then III.

Essentially any type of emulsion (e.g., negative-working emulsions such as surface-sensitive emulsions of unfogged internal latent image-forming emulsions, direct-positive emulsions such as surface fogged emulsions, or others described in, for example, *Research Disclosure I*) may be used. The above-described sensitizing dyes can be used alone, or may be used in combination with other sensitizing dyes, for example to also provide the silver halide with sensitivity to wavelengths of light outside the green region or to supersensitize the silver halide.

Other addenda in the emulsion may include antifoggants, stabilizers, oxidized developer scavangers, filter dyes, light absorbing or reflecting pigments, vehicle hardeners such as gelatin hardeners, coating aids, dye-forming couplers, and development modifiers such as development inhibitor releasing (DIR) couplers, timed development inhibitor releasing couplers, ultraviolet absorbers, bleach accelerators, and the like. These addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art and are used to counteract dye stain, although the dyes of the present invention generally have low dye stain even if no brightener is used.

The emulsion layer containing silver halide sensitized with dyes of the present invention can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers (which class includes DIAR couplers), antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic elements of the present invention can be black and white but are preferably color. A color photographic element generally contains three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

It should be noted at this point that color reversal films have higher contrasts and shorter exposure latitudes than color negative film. Moreover, such reversal films do not have masking couplers, and this further differentiates reversal from negative working films. Furthermore, reversal films have a gamma generally between 1.8 and 2.0, and this is much higher than for negative materials.

Photographic elements of the present invention may also usefully include a magnetic recording layer as described in *Research Disclosure,* Item 34390, November 1992.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. In the case of processing a reversal color element, the element is first treated with a black and white developer followed by treatment with a color developer.

The invention is described further in the following Examples. All dye levels expressed below are expressed in mmoles per mole of silver unless otherwise indicated. All silver halide emulsion particle sizes given are average figures obtain by disc centrifuge, unless otherwise indicated. All speed units are 100×logE unless otherwise noted. All sensitivities in all examples under "Peak Sensitivity" (or "$\lambda_{max}$" sometimes used to designated peak sensitivity), were substantially flat over the indicated ranges, with the exception of #C at LTAI (the sensitivity of which increased toward the higher end of the range), or except as noted.

EXAMPLE 1

A 0.68 μm 2% I silver bromoiodide polymorphic emulsion was spectrochemically sensitized with typical chemical sensitizers such as NaCNS, sodium thiosulfate, KAuCl4, and 3-methylbenzothiazolium iodide in the presence of the dyes as shown in Table 1 during digestion. After NaCNS, dye I-1 was added first followed by II-1 and then III-1 before sodium thiosulfate. Dyes were added during chemical sensitization. The emulsions were coated in a single layer with two levels of TAI, and were green light exposed and processed in Kodak E6 reversal process (the British *Journal of Photography Annual,* 1982, pages 201 to 203) to form positive color image to determine speed (4 min 1st developer time). The speed was measured at a density of maximum density (Dmax) minus 0.3. The fog was determined by developing in the first black and white developer for four minutes followed by converting to form a negative color image using a modified reversal process (rehalogenated process). Spectral sensitivity was measured by exposing coatings with a 11 step, 0.31 logE/-step wedge spectral exposure for 1/25 sec using a tungsten halogen light source and processing them for 4 min. in the first developer in the rehalogenated process. The spectral sensitivity was measured at 0.3 above fog. The levels of TAI were 0.22 and 1.1 g per one mole of silver for low TAI ("LTAI") and a high TAI ("HTAI"), respectively. Four sensitization samples #A,B,C, and D were prepared as below in Table 1, and their photographic characteristics listed. Note that sample D of the present invention yielded a desirable spectral peak sensitivity around 550 μm–580 μm which would provide good orange color reproduction, and exhibited good speed with no speed loss when the TAI level was increased. A combination of Dyes I-1 and III-1 (sample C) at the ratio suggested by Mihara et al (U.S. Pat. No.

4,362,813) gave too much long green sensitivity (which would yield yellow contaminated green and orange colored objects) and suffered from a large speed loss in the presence of high level of TAI.

TABLE 1

| # | Dye/level variations I-1 | II-1 | III-1 | total | Peak Sensitivity | Fog LTAI | Fog HTAI | Speed LTAI | Speed HTAI |
|---|---|---|---|---|---|---|---|---|---|
| A | 0 | 0.147 | 0.275 | 0.422 (comparison) | 550–560 nm | 0.10 | 0.08 | 200 | 196 |
| B | 0 | 0.208 | 0.275 | 0.483 (comparison) | 550–565 nm | 0.08 | 0.10 | 203 | 200 |
| C | 0.208 | 0 | 0.275 | 0.483 (comparison) | 560–590 nm* | 0.16 | 0.12 | 211 | 189 |
| D | 0.062 | 0.147 | 0.275 | 0.483 (invention) | 555–580 nm | 0.13 | 0.12 | 205 | 205 |

*LTAI increased the 590 nm peak sensitivity.
Note: speed = 100 × logE

EXAMPLE 2

The following samples #E→J have been prepared as in Example 1 except that various levels of dye I-1 were used with the levels of II-1 and III-1 held constant (II-1 level at 0.147; III-1 level at 0.275). As shown below, there were optimum levels of dye I-1 for desirable spectral sensitivity. Note that the samples F-J had improved speed over E (no I-1 present), with samples G and H providing the highest improved speed. Note also that samples G and H have the most desirable peak sensitivity, both near 560–580 nm.

TABLE 2

| Sample | Dye I-1 level (mm/mole Ag) | Peak Sensitivity | Fog (LTAI) | Speed (LTAI) | Speed Increase[a] |
|---|---|---|---|---|---|
| E | 0 (comparison) | 550–560 nm | 0.11 | 254.5 | — |
| F | 0.031 (comparison) | 550–565 nm | 0.09 | 260.5 | +6 |
| G | 0.062 (invention) | 560–580 nm | 0.15 | 263.0 | +10.5 |
| H | 0.092 (invention) | 565–580 nm | 0.13 | 267.0 | +12.5 |
| I | 0.123 (comparison) | 580 nm | 0.32 | 262.5 | +8 |
| J | 0.154 (comparison) | 580 nm | 0.64 | 259.5 | +5 |

[a]Speed increase compared to Sample E

EXAMPLE 3

A 0.3 μm 4.8% I silver bromoiodide emulsion was optimally spectrochemically sensitized with typical sensitizers such as NaCNS, sodium thiosulfate, and sodium aurous(I)dithiosulfate in the presence of the green spectral sensitizers indicated in Table 3 below. The emulsions were coated and evaluated as in Example 1 except that level of TAI was 3.5 g TAI per one mole of silver in each sample. As shown below, the inventive samples K and L provided higher speed and accurate green Spectral sensitivity than any of the comparison compositions.

TABLE 3

| Sample | Dye/level variation I-1 | II-1 | III-1 | Total | % FOG* | Speed | Peak Sensitivities |
|---|---|---|---|---|---|---|---|
| K (I) | .078 | 0.25 | 0.495 | 0.823 | 4.6 | 217 | 555–575 nm |
| L (I) | .156 | 0.25 | 0.495 | 0.901 | 5.9 | 220 | 555–575 nm |
| M (C) | 0 | 0.328 | 0.495 | 0.823 | 3.6 | 214 | 560 nm |
| N (C) | .328 | 0 | 0.495 | 0.823 | 3.3 | 206 | 550–585 nm |
| O ( ) | .206 | 0 | 0.617 | 0.823 | 3.7 | 209 | 553 nm |

(I) = invention dye compositions
(C) = comparison dye compositions
*% Fog = % silver fogged relative to total silver coated.

EXAMPLE 4

Samples K and L in Example 3 were compared with corresponding samples but in which dye II-1 was replaced with either of two comparison dyes C-1 or C-2 (structures shown later). The results from the foregoing are provided in Table 4 below. Note that the comparison compositions P, Q, R and S were much lower in speed and have an undesirably short peak sensitivity ($\lambda_{max}$) than the samples of the present invention.

TABLE 4

| # | Dye/level variation I-1 | II-1 | C-1 | C-2 | III-1 | % FOG | Speed | Peak Sensitivities |
|---|---|---|---|---|---|---|---|---|
| K (I) | .078 | 0.25 | 0 | 0 | 0.495 | 4.6 | 217 | 555–575 nm |
| L (I) | .156 | 0.25 | 0 | 0 | 0.495 | 5.9 | 220 | 555–575 nm |
| P (C) | 0.78 | 0 | 0.25 | 0 | 0.495 | 3.7 | 194 | 540–560 nm |
| Q (C) | .156 | 0 | 0.25 | 0 | 0.495 | 3.7 | 204 | 550 nm |
| R (C) | .078 | 0 | 0 | 0.25 | 0.495 | 3.7 | 197 | 550 nm |
| S (C) | .156 | 0 | 0 | 0.25 | 0.495 | 4.2 | 203 | 560 nm |

EXAMPLE 5

Example 1 was repeated except that either dye I-1 or I-2 was used in order to compare their performance. The dyes were added after heat digestion (chemical sensitization) and levels of TAI were 0.25 g (indicated as "L" under "TAI" in Table 5 below) and 1.75 g (indicated as "H" under "TAI" in Table 5 below) per mole of silver. Note that the sample X lost as much as 11 units speed at the high level of TAI when compared to the low level of TAI. The inventive sample Y using dye I-2 provided speed and spectral sensitivity similar to the inventive sample T using dye I-1. Note that inventive samples T, V, and Y provided similar speeds regardless of the TAI level.

TABLE 5

| # | Dye/level variation I-1 | II-2 | II-1 | III-1 | TAI | % FOG | Speed | $\lambda_{max}$ |
|---|---|---|---|---|---|---|---|---|
| T (I) | 0.046 | 0 | 0.134 | 0.274 | L | 2.5 | 257 | 557–573 nm |
| T (I) | 0.046 | 0 | 0.134 | 0.274 | H | 2.5 | 256 | 547–573 nm |

TABLE 5-continued

| # | Dye/level variation I-1 | II-2 | II-1 | III-1 | TAI | % FOG | Speed | $\lambda_{max}$ |
|---|---|---|---|---|---|---|---|---|
| V (I) | 0.092 | 0 | 0.134 | 0.274 | L | 3.1 | 258 | 555–580 nm |
| V (I) | 0.092 | 0 | 0.134 | 0.274 | H | 5.7 | 261 | 565–580 nm |
| W (C) | 0 | 0 | 0.18 | 0.274 | L | 2.6 | 254 | 550 nm |
| W (C) | 0 | 0 | 0.18 | 0.274 | H | 3.0 | 256 | 550 nm |
| X (C) | 0.18 | 0 | 0 | 0.274 | L | 2.5 | 256 | 550–590 nm |
| X (C) | 0.18 | 0 | 0 | 0.274 | H | 3.1 | 245 | 590 nm |
| Y (I) | 0 | .046 | 0.134 | 0.274 | L | 3.1 | 257 | 550–580 nm |
| Y (I) | 0 | .046 | 0.134 | 0.274 | H | 3.1 | 257 | 550–580 nm |

EXAMPLE 6

The procedure of Example 5 to produce samples T and V was repeated, except that dye II-1 was replaced with comparative dyes C-1 and C-2 which have the following structures:

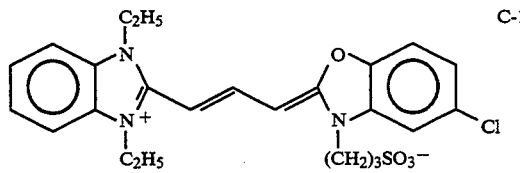

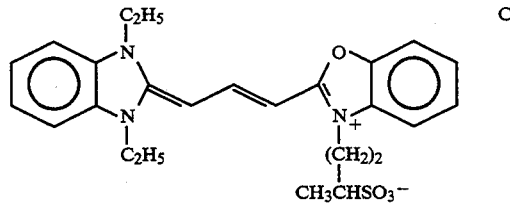

The results are provided in Table 6 below. Note that all of the samples of this example are comparisons (shown by a "(c)"). As shown, samples Z to CC showed maximum sensitivities at about 550 nm with slightly smaller 590 nm sensitivity peaks and low speeds: 13 to 19 and 17 to 29 CR slower than the inventive samples.

TABLE 6

| # | Dye/level variation I-1 | II-1 | C-1 | C-2 | TAI | % FOG | Speed | $\lambda_{max}$ |
|---|---|---|---|---|---|---|---|---|
| Z (C) | 0.046 | 0 | 0.134 | 0 | L | 2.6 | 239 | 557 nm |
| Z (C) | 0.046 | 0 | 0.134 | 0 | H | 2.6 | 239 | 550 nm |
| AA (C) | 0.092 | 0 | 0.134 | 0 | L | 3.0 | 245 | 550 nm* |
| AA (C) | 0.092 | 0 | 0.134 | 0 | H | 2.5 | 245 | 540–560 nm* |
| BB (C) | 0.046 | 0 | 0 | 0.134 | L | 2.6 | 232 | 550 nm |
| BB (C) | 0.046 | 0 | 0 | 0.134 | H | 2.6 | 230 | 550 nm |
| CC (C) | 0.092 | 0 | 0 | 0.134 | L | 2.5 | 241 | 540–550 nm* |
| CC (C) | 0.092 | 0 | 0 | 0.134 | H | 5.4 | 236 | 540–550 nm* |

*Showed another minor peak at 590 nm

EXAMPLE 7

Using cellulose triacetate film supports, multilayer color light sensitive materials, each consisting of the following layers, were prepared according to the following general structure First layer: An antihalation layer containing 0.48g/m$^2$ colloidal silver and 3.67 g/m$^2$ gelatin Second layer: A first red sensitive emulsion layer containing 0.41 g/m$^2$ 4.8% I silver bromoiodide emulsion with 0.42 g/m$^2$ cyan coupler COUP-1, 0.022 g/m$^2$ of DIAR coupler DIAR-1, and 1.52 g/m$^2$ gelatin Third layer: A second red sensitive emulsion layer containing 1.04 g/m$^2$ 3% I silver bromoiodide emulsion with 0.98 g/m$^2$ coupler COUP-1, 0.032 g/m$^2$ DIAR-1 and 1.45 g/m$^2$ gelatin Fourth layer: An 0.62 g/m$^2$ gelatin intermediate layer containing 0.15 g/m$^2$ of oxidized developer scavenger S-1

Fifth layer: A first green sensitive emulsion layer containing 0.52 g/m$^2$ 4.8% I silver bromoiodide emulsion (70:30 blend of 0.3 μm and 0.15 μm grains) with 0.48 g/m$^2$ of a mixture of magenta couplers COUP-2 (30%) and COUP-2A (70%), 0.016 g/m$^2$ surface fogged 0.15 μm 4.8% I fine grain silver bromoiodide and 2.23 g/m$^2$ gelatin Sixth layer: A second green sensitive emulsion layer containing 1.05 g/m$^2$ 2% I silver bromoiodide emulsion with 0.84 g/m$^2$ coupler COUP-2 and 1.74 g/m$^2$ gelatin Seventh layer: A 0.62 g/m$^2$ gelatin intermediate layer Eighth layer: A 0.62 g/m$^2$ gelatin intermediate layer containing 0.08 g/m$^2$ colloidal silver Ninth layer: A first blue sensitive emulsion layer containing 0.57 g/m$^2$ 3.4% I silver bromoiodide emulsion with 0.73 g/m$^2$ yellow coupler COUP-3 and 1.35 g/m$^2$ gelatin Tenth layer: A second blue sensitive emulsion layer containing 1.07 g/m$^2$ 2% I silver bromoiodide emulsion with 1.61 g/m$^2$ coupler COUP-3 and 2.7 g/m$^2$ gelatin Eleventh layer: A first protective layer containing ultraviolet absorber dyes and 1.40 g/m$^2$ gelatin Twelfth layer: A second protective layer containing polymethyl methacrylate particles at 0.02 g/m$^2$ and gelatin at 0.98 g/m$^2$.

In addition to the above composition, surfactants were incorporated to improve coatability and films were hardened by bis(vinylsulfonyl)methyl ether ("BVSME").

Two samples, Samples 1 and 2, were prepared according to the above structure but with the addition of the dyes indicated below to both green layers:

Sample 1

Emulsions were optimally sensitized by Type II-1 and Type III-1 at the ratio of 1:1.86 for comparison. The respective dye levels used were (in mmoles per silver mole) were: 0.147 and 0.274 for the 6th layer emulsion, and 0.247 and 0.46 for the 0.3 μm emulsion; and 0.286 and 0.533 for the 0.15 μm emulsion in the fifth layer. These sensitizing dyes were added after chemical sensitization.

Sample 2

Emulsions were optimally sensitized by using a ternary combination of Type I-1, Type II-1, and Type III-1 for an inventive example. The respective dye levels used (in mmoles per silver mole) were:

0.062, 0.147, and 0.274 for the 6th layer emulsion; 0.108, 0.352, and 0.458 for 0.3 μm emulsion and 0.195, 0.635, and 0.825 for 0.15 μm emulsion in the fifth layer. These sensitizing dyes were present during chemical sensitization.

The above samples were exposed to simulated daylight and processed through Kodak Process E6 (6 minutes black and white development time). The photographic speed was determined by exposing through a step tablet at three different regions: threshold speed was measured at a shoulder region (that is, near maximum density, Dmax.) at 1.0 density and at 0.05 density. Table 7 below shows the film speeds for these two samples:

TABLE 7

| Samples | Threshold | D = 1.0 | D = 0.5 |
|---|---|---|---|
| 1 (comparison) | 191 | 98 | 55 |
| 2 (invention) | 208 | 119 | 68 |

Note: Speed units are in 100 × log E

As can be seen from Table 7, Sample 2 of the invention exhibited considerable speed increase over Sample 1. Spectral sensitivity measurement indicated that Sample 2 provided accurate sensitivities to green, orange or red objects while Sample 1 does not provide adequate long green sensitivity in the 560–580 nm region.

EXAMPLE 8

A Sample 3 of the present invention was prepared similar to Sample 2 of Example 4 except the second through twelfth layers were modified with the changes indicated below:

Second layer: 0.52 g/m$^2$ emulsion with 0.19 g/m$^2$ coupler COUP-1, 0.0043 g/m$^2$ DIAR-1, 0.039 g/m$^2$ of oxidized developer scavenger S-2, and 0.097 g/m$^2$ poly(thioethylene glutarate)

Third layer: 0.972 g/m$^2$ emulsion with 1.30 g/m$^2$ coupler COUP-1, 0.039 g/m$^2$ DIAR-1 coupler and 1.78 g/m$^2$ gelatin Fourth layer: 0.76 mg/m$^2$ silver halide inhibitor releaser IR-1, 2.2 mg/m$^2$ of red absorber dye RDye-1

Fifth layer: 0.59 g/m$^2$ green sensitized 4.8% I silver bromoiodide emulsion (70:30 blend of 0.3 μm and 0.15 μm grains) with 0.53 g/m$^2$ of the same COUP-2 and COUP-2A mixture, 0.018 g/m$^2$ surface fogged 0.15 μm 4.8% I fine grain silver bromoiodide, 0.14 g/m$^2$ poly(thioethylene glutarate) and 1.51 g/m$^2$ gelatin. The 0.3 μm emulsion was sensitized by using the present inventive dye combination: 0.107 type I-1, 0.353 type II-1, and 0.458 type III-1 in mmoles/Ag mole added during chemical sensitization as described in Example 1. The 0.15 μemulsion and the surface fogged grain were the same as Sample 2.

Sixth layer: 0.86 g/m$^2$ 2% I silver bromoiodide emulsion sensitized by the present inventive dye combination—0.046, 0.147 and 0.274 mmoles/Ag mole for type I-1, II-1, and III-1 respectively, added after chemical sensitization, and 0.11 g/m$^2$ 4.8% I silver bromoiodide emulsion described in the fifth layer with 1.08 g/m$^2$ of a mixture of magenta couplers COUP-2 (30%) and COUP-2A (70%)

Seventh layer: also contained 0.22 mg/m$^2$ yellow absorber dye YDYE-1 and 0.014 mg/m$^2$ of green absorber dye GDYE-1

Eighth layer: also contained 0.11 g/m$^2$ oxidized developer scavenger S-2

Ninth layer: 0.81 g/m$^2$ COUP-3 and 13 mg/silver mole poly(thioethylene glutarate)

Tenth layer: 0.86 g/m$^2$ 2% I silver bromoiodide emulsion and 0.15 g/m$^2$ 4.8I 0.15μ fine grain emulsion with 1.52 g/m$^2$ COUP-3 and 2.55 g/m$^2$ gelatin Eleventh layer: Contained 0.065 g/m$^2$ of ultraviolet absorber dye UV-1 and 1.08 g/m$^2$ gelatin Twelfth layer: 0.91 g/m$^2$ gelatin, 2.7 mg/m$^2$ colloidal silver and 0.13 g/m$^2$ Lippmann AgBr emulsion Comparative sample 4 was prepared like sample 3 except green sensitive emulsions were prepared by using dyes I-1 and type III-1 dyes at the following ratios shown in Table 8 providing accurate spectral sensitivity (broad peaks in the 550–580 μm range) and coated at 10% thinner to match reversal maximum density.)

TABLE 8

| Emulsion | Dye levels, mmoles/Ag mole[c] | |
|---|---|---|
| | Type III-1 | Type I-1 |
| 2% emulsion (a) | 0.23 | 0.467 |
| 0.3 μm emulsion (a,b) | 0.24 | 0.730 |
| 0.15 μm emulsion (b) | 0.43 | 0.934 |

(a) = Sixth layer of Sample 4

(b) = Fifth layer of Sample 4

Note: After chemical sensitization, dye type III-1 was added and then dye I-1 was added.

Speeds were measured as described in Example 7 and compared in Table 9 below. This example demonstrated the speed advantage of the invention sample.

TABLE 9

| Samples | Threshold | D = 1.0 | D = 0.5 |
|---|---|---|---|
| 4 (control) | 194 | 90 | 63 |
| 3 (invention) | 205 | 103 | 54 |

Structures of compounds used in some of the above examples, are as follows:

DIAR-1

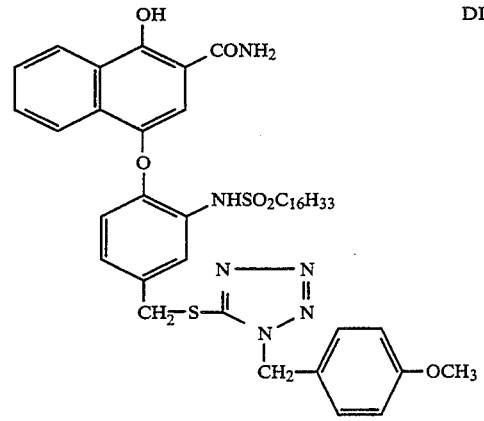

-continued

COUP-1

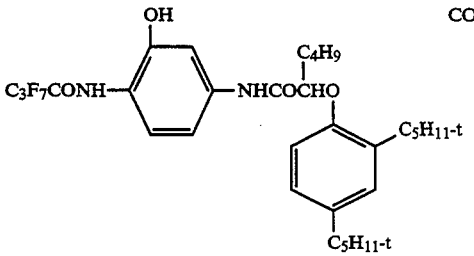

S-1

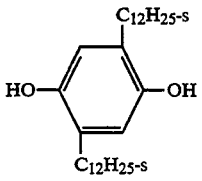

COUP-3

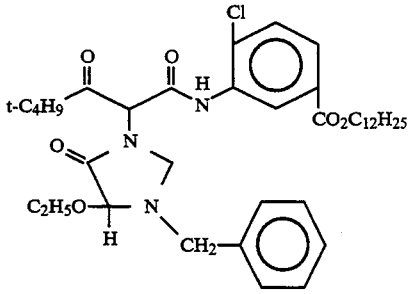

IR-1

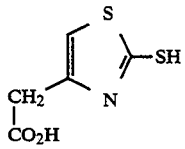

RDYE-1

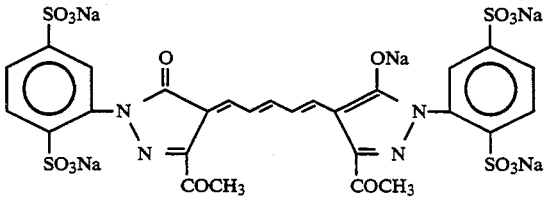

YDYE-1

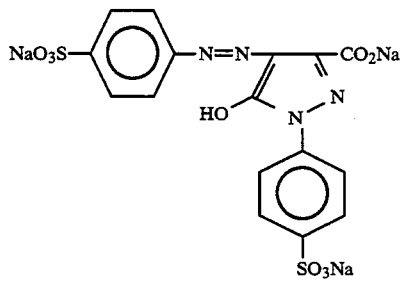

GDYE-1

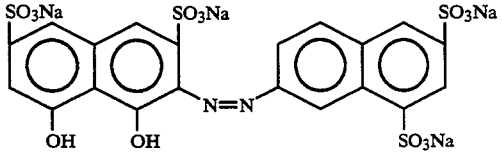

-continued

S-2

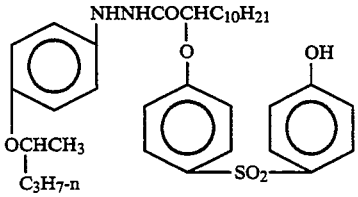

UV-1

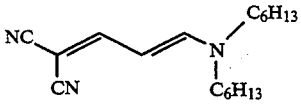

COUP-2A

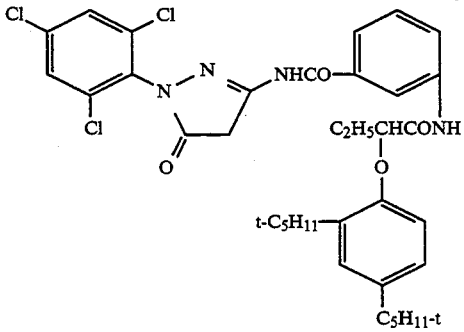

COUP-2

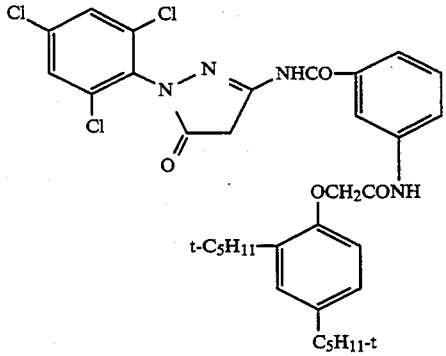

The present invention has been described in detail with particular reference to preferred embodiments, but it will be understood that variations and modifications can be effected within the spirit and scope of the invention.

What is claimed is:

1. A silver halide photographic element having a green sensitive layer comprising silver halide grains sensitized with a combination of three sensitizing dyes of formulae I, II and III:

(I)

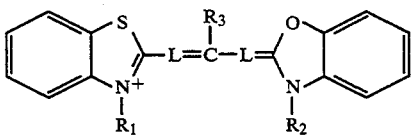

(II)

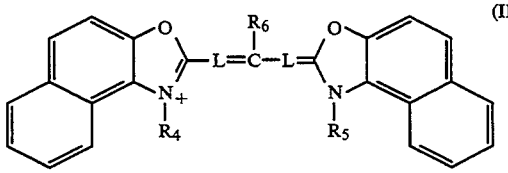

-continued

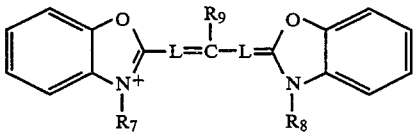

(III)

wherein:

each of the benzo-rings of I, II or III may be substituted or unsubstituted;

each L is a substituted or unsubstituted methine; and $R_1$ through $R_9$ are substituted or unsubstituted alkyl or aryl;

and wherein the ratio of the amount of I to II to III is in the range 1:1.2:2.3 to 1:4:8.

2. A silver halide photographic element according to claim 1 wherein each of the three dyes has at least one acid or acid salt group located other than on $R_3$, $R_6$, or $R_9$.

3. A silver halide photographic element according to claim 1 wherein R1 through R9 are lower alkyl, and at least one of $R_1$–$R_3$ is acid or acid salt substituted, at least one of $R_4$–$R_6$ is acid or acid salt substituted, and at least one of $R_7$–$R_9$ is acid or acid salt substituted.

4. A silver halide photographic element according to claim 1 wherein $R_3$, $R_6$, or $R_9$ are substituted or unsubstituted lower alkyl, and at least one of $R_1$ and $R_2$, at least one of $R_4$ and $R_5$, and at least one of $R_7$ and $R_8$, is acid or acid salt substituted lower alkyl.

5. A silver halide photographic element according to claim 1 wherein $R_3$, $R_6$, and $R_9$ are substituted or unsubstituted lower alkyl, and $R_1$, $R_2$, $R_4$, $R_5$, $R_7$ and $R_8$, are acid or acid salt substituted lower alkyl.

6. A silver halide photographic element according to claim 1 wherein the total amount of the dyes I, II and III in the layer is between 0.01 to 5 millimoles per mole of silver halide.

7. A silver halide photographic element according to claim 1 additionally comprising a development inhibitor releasing compound in a layer associated with the layer in which the dyes are located.

8. A silver halide photographic element according to claim 1 wherein the silver halide is silver bromoiodide.

9. A silver halide photographic element having a green sensitive layer comprising silver halide grains sensitized with a combination of three sensitizing dyes of formulae Ia, IIa and IIIa:

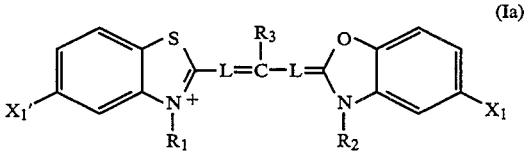

(Ia)

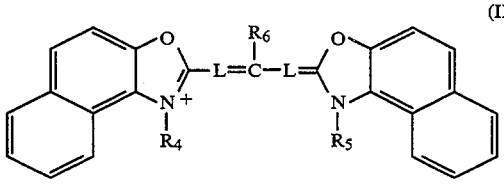

(IIa)

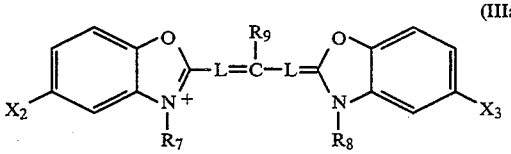

(IIIa)

wherein:

each of the benzo-rings of Ia, IIa or IIIa may be further substituted or unsubstituted;

each L is a substituted or unsubstituted methine;

$R_1$ through $R_9$ are substituted or unsubstituted alkyl or aryl;

one of $X_1$ or $X_1'$ is halogen or a substituted or unsubstituted aryl while the other is H; and $X_2$ and $X_3$ are halogen;

and wherein the ratio of the amount of Ia to IIa to IIIa is in the range 1:1.2:2.3 to 1:4:8.

10. A silver halide photographic element according to claim 9 wherein one of $X_1$ or $X_1'$ is a substituted or unsubstituted phenyl or Cl or F, and $X_2$ and $X_3$ are independently Cl or F.

11. A silver halide photographic element according to claim 10 wherein $X_1$, $X_2$ and $X_3$ are Cl.

12. A silver halide photographic element according to claim 9 wherein the total amount of the dyes Ia, IIa and IIIa in the layer is between 0.01 to 5 millimoles per mole of silver halide.

13. A silver halide photographic element according to claim 9 wherein the element is a color reversal film.

14. A silver halide photographic element according to claim 9 wherein the benzo-rings of each of the dyes do not have substituents other than $X_1$, $X_2$ and $X_3$.

15. A silver halide photographic element according to claim 9 wherein each L is unsubstituted.

16. A silver halide photographic element according to claim 9 wherein $X_1$, $X_2$ and $X_3$ are Cl.

* * * * *